United States Patent [19]

Greding et al.

[11] 4,420,996

[45] Dec. 20, 1983

[54] SLITTER INDEXING SYSTEM

[75] Inventors: Robert Greding, Beaconsfield; Rodney H. Bryce, Lachine, both of Canada

[73] Assignee: Canadian General Electric Company Limited, Toronto, Canada

[21] Appl. No.: 340,731

[22] Filed: Jan. 19, 1982

[30] Foreign Application Priority Data

Jan. 23, 1981 [CA] Canada ..... 369244

[51] Int. Cl.[3] ..... B26D 1/24; B26D 7/26

[52] U.S. Cl. ..... 83/13; 33/185 R; 83/498; 83/508.3

[58] Field of Search ..... 83/498, 499, 504, 508.3, 83/508.2, 13; 33/185 R, 186, 174 R

[56] References Cited

U.S. PATENT DOCUMENTS

| | | | |
|---|---|---|---|
| 593,341 | 11/1897 | Thomas | 33/185 R |
| 967,994 | 8/1910 | Stoddard | 83/508.3 |
| 1,118,831 | 11/1914 | Vickery | 83/498 |
| 2,659,436 | 11/1943 | Dutro et al. | 83/498 X |
| 2,992,661 | 7/1961 | Burelbach | 83/508.3 |
| 3,834,258 | 9/1974 | Zumstein | 83/508.3 X |
| 4,077,291 | 3/1978 | Obenshain | 83/508.3 X |
| 4,269,097 | 5/1981 | Linn | 83/504 X |
| 4,316,317 | 2/1982 | Ritzling | 33/185 R X |

FOREIGN PATENT DOCUMENTS

| | | | |
|---|---|---|---|
| 714352 | 7/1965 | Canada | 164/60 |

*Primary Examiner*—Frank T. Yost
*Attorney, Agent, or Firm*—R. A. Eckersley

[57] ABSTRACT

A paper slitter machine having a plurality of slitter heads in mutually spaced apart relation located across the width of the machine, each slitter head having a slitter disc operable in cooperating relation with a respective annular disc or slitter band mounted for rotation on a shaft, for the slitting of a paper web into discrete width portions on passage of the web past the slitter heads, is provided with a plurality of slitter indexing means mounted on traverse means for retraction to a position clear of the machine, the slitter indexing means having a slitter stop for each slitter head, the stops being adjustable upon the traverse means to permit pre-indexing of each of the stops to a desired predetermined position along the length of the traverse means such that, with the traverse means repositioned within the slitter machine and having the stops positioned in an operative position, each of the slitter heads may then be brought rapidly into indexed relation with the respective pre-set stop, whereby the slitter machine may be re-indexed with a minimum of down time. The indexing of the slitter machine is generally achieved in this arrangement by moving each of the annular slitter band discs into abutting relation with the respective pre-set stop, and thereafter bringing the respective disc into operative relation with the respective indexed slitter band disc.

12 Claims, 3 Drawing Figures

SLITTER INDEXING SYSTEM

This invention is directed to a slitter apparatus, and in particular to a slitter indexing system for use in adjusting the slitter.

In the operation of high productivity machines wherein the value of the product is high, such as in paper making machines and associated ancillary machines, the cost of downtime, when the machine is not in operation, is of such importance that significant efforts and large sums of money are invested to limit to a minimum those aspects of operation which result in machine downtime.

In the case of slitting machines which operate upon endless webs of material, such as the product of a paper machine, to reduce the initial wide web into a series of narrower webs during winding or rewinding of the web, much effort and money has been expended in providing adjustable slitting means. The primary effort has been directed to remotely adjustable slitter heads wherein, upon termination of the operation of the machine, the relative positions of the slitter heads are indexed by remote controls located outside of the machine, into desired new indexed positions. While such arrangements offer certain advantages over earlier systems, the rate of operation is generally dependent upon sequential setting of each of the heads, while the cost of the remote control system is very high.

In accordance with the present invention there is provided a slitter indexing arrangement including presettable stops for each slitter head, being retractable from out of the machine while the machine continues in operation. The plurality of adjustable stops is mounted on a retractable traverse means, for withdrawal from the machine. The stops can be readily pre-set with the traverse means standing in the aisle in front of the slitting machine. The traverse means can then be repositioned within the slitter machine, preparatory to re-indexing the machine. Upon halting the operation of the slitter machine, the pre-set stops may then be brought into an indexing position with the respective slitter heads, and each of the slitter heads then adjusted into indexed relation with the respective stop. Due to the independent presetting of each of the stops it is possible to utilize the services of a machine attendant for each slitter head in the machine re-setting operation so that all heads can be simultaneously brought into registry with the respective pre-set stop, so that machine downtime is effectively minimized.

It will be understood that the subject arrangement is simple and uncomplicated and leads itself to a low cost arrangement capable of highly accurate setting; and requiring minimum machine downtime for its operation.

In order to minimize downtime the present invention provides an index stop traverse means wherein the adjustable stops are pre-set in the aisle and the traverse means is inserted into the normally still-operating slitter machine, having the index stops withdrawn in a retracted position, clear of the slitter heads. In one embodiment the stops are individually extensible into engagement with the slitter heads. In a further embodiment the slitter stops are displaced bodily and collectively into contactable relation with an index portion of each slitter head.

Certain embodiments of the present invention are described, reference being made to the accompanying drawings, wherein.

Figure 1:
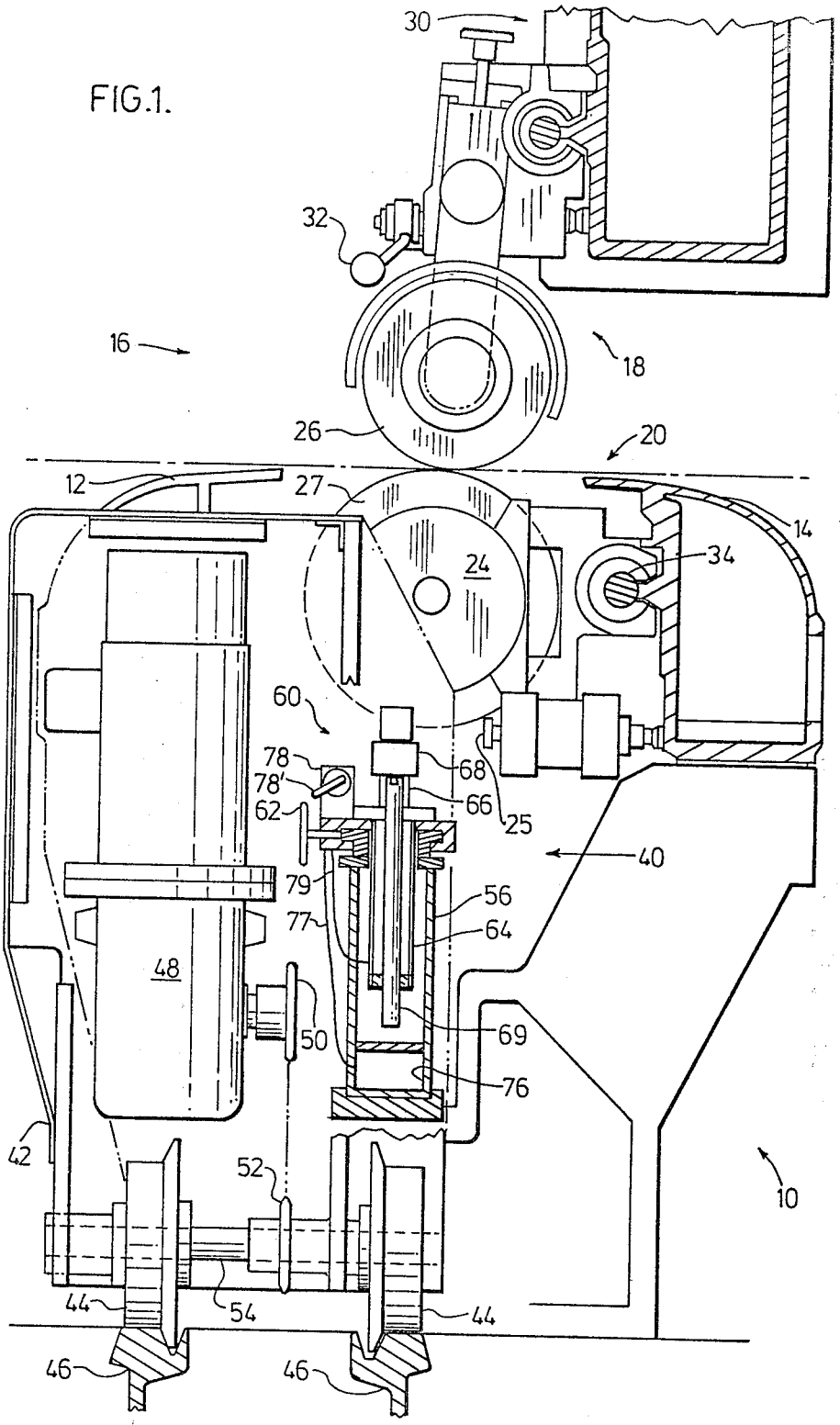
FIG. 1 is an end view in elevation of a first embodiment having carriage traverse means, showing a portion of carriage and its stop indexing means relative to one of the slitter heads.
Figure 3:
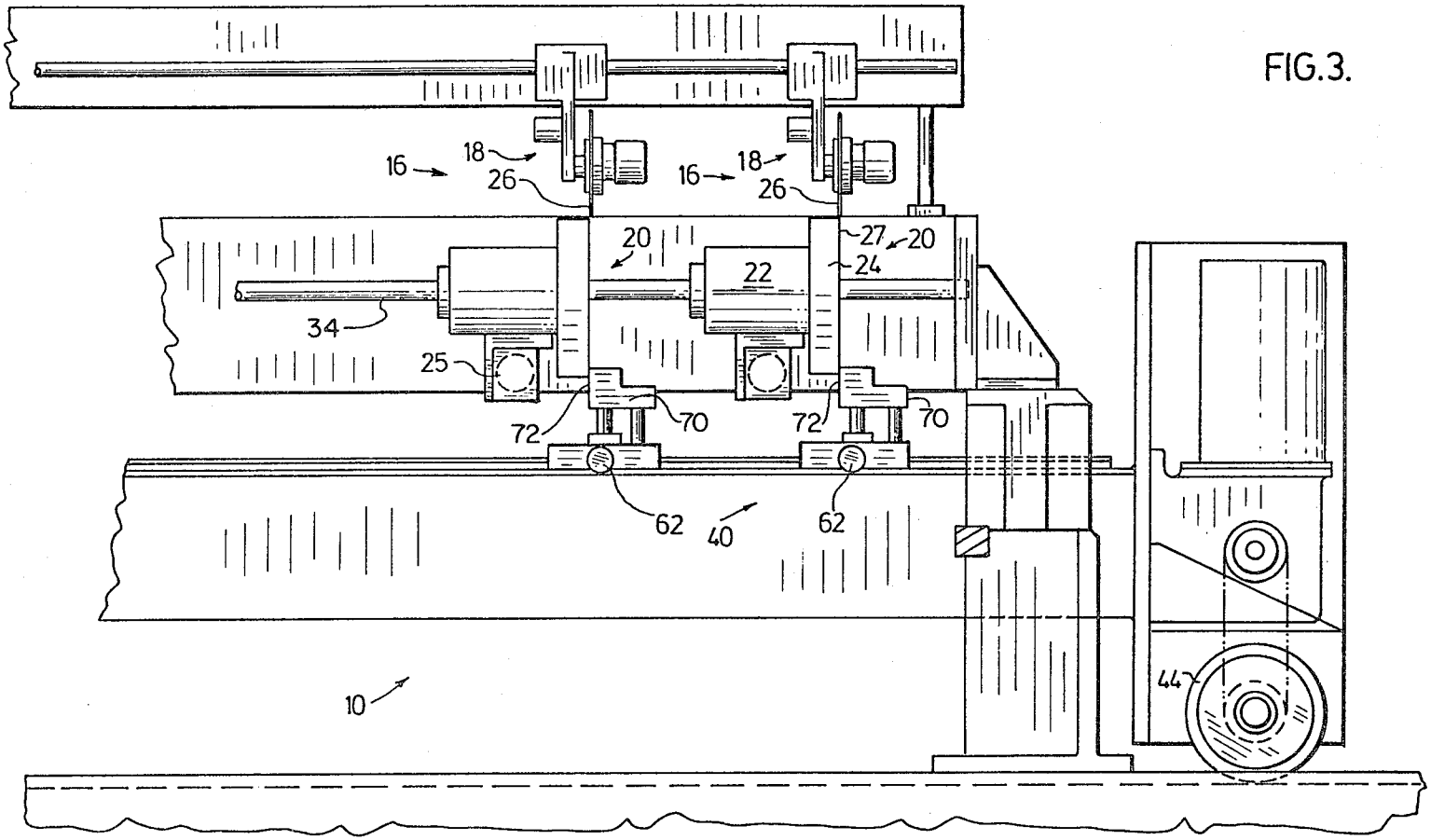
FIG. 3 is a front view of a portion of the slitter embodiment of FIG. 1.

Referring first to FIG. 1, a cross-sectional view of a slitter machine 10 is shown, looking from the direction of the front aisle, which aisle is located on the right hand side of the machine as viewed in FIG. 3.

The machine 10 has a pair of draw tables 12, 14, the top surfaces of which define the pass-line of the web. Two slitter heads 16 are shown, there being usually about fifteen such heads provided. Each head 16 has an upper portion 18 and a lower portion 20. The lower portion 20 comprises an electric drive motor 22, generally of variable speed DC type having a shaft-mounted annular cutting disc 24 (sometimes known as a "slitter band") mounted thereon. A locking handle 25 serves to releasably secure the head portion 20 to beam portion 34 of the machine. The upper head portion 18 comprises a rotatably mounted cutting disc 26 set in cutting relation with the lower disc 24. The upper portion 18 of the slitter head is slideably mounted on beam 30, having a clamping handle 32 for securing the upper head portion 18 to the beam 30 in predetermined spaced relation therealong, in cutting relation with the slitter band, disc 24.

The subject indexing mechanism 40, of the Figures' 1 and 3 embodiment, is mounted upon a traverse means comprising a wheeled carriage 42, the wheels 44 of which are carried by rails 46. The rails 46 extend transversely of the machine 10, and across the front aisle, to permit bodily withdrawal of the indexing mechanism 40 from out of machine 10 into the aisle. A motor 48 has an output sprocket 50 connected by a chain to drive sprocket 52 mounted on the axle 54 of the carriage 42.

A slideway 56 carries a plurality of indexing means 60 in variably positionable relation therealong, there being one indexing means 60 for each of the slitter heads 16. The indexing means 60 has a locking handle 62 for releasably securing it to the slideway 56. The indexing means 60 comprises a piston and cylinder actuator, having cylinder 64 with piston rod 66 extending upwardly therefrom. A cross head 68 has a guide rod 69 depending therefrom. The rod 69 maintains the orientation of the cross head 68 and indexing means 60. The indexing means 60 has an index contact portion 70, with an index face 72 providing stopping contact with the working face 27 of the cutting disc 24.

The carriage 42 has an air duct 76 underlying the slideway 56, from which an air supply hose 77 connected to control valve 78 provides air, by way of connecting hose 79 to the cylinder 64 of the indexing means. Operation of air control handle 78' to admit air to the cylinder 64 raises the cross head 68 sufficiently to bring the index contact 70 into registrable contact with the working face 27 of the disc 24.

Carriage positioning stops (not shown) serve to precisely locate the carriage 42 in the cross machine direction, when inserted into the slitter machine.

In operation, the carriage 42 is withdrawn from the machine 10, into the aisle, and the respective indexing mechanisms are positioned longitudinally along the slideway 56 to predetermined positions and each locked in position by actuation of its locking handle 62.

The preconditioned carriage 42 is then repositioned within the machine 10, against the carriage stops (not shown) preparatory to re-indexing the slitter.

The operation of slitter 10 is terminated and the web removed.

A number of machine operators can then enter the section to release the locking handles 25 of the slitter head lower portions 20, (and also to release slitter upper portions 18, by way of releasing clamping handles 32) so as to permit repositioning of the head portions 20, 18 away from the cross heads 68.

The control valve 78 for each stop means is opened to admit air in pressurizing relation to cylinder 64, raising the pre-set cross head 68 upwardly into its operative position. The respective slitter head lower portion 20 is moved transversely, in order to bring the annular working face 27 of disc 24 into indexed registry with the index face 72 of the contact portion 70, where it is relocked in position. The control valve 78 is then actuated to release the cross head downwardly out of engagement with the slitter head.

The slitter head upper portion 18 is repositioned into indexed relation with the head lower portion 20, and the slitter 10 is then ready for further operation.

It will be seen that the indexing mechanism 40 is always available for withdrawal into the aisle, to permit pre-setting of the respective stop means and reinsertion of the indexing mechanism prior to shutdown of the slitter 10 for carrying out a re-setting operation.

Figure 2:
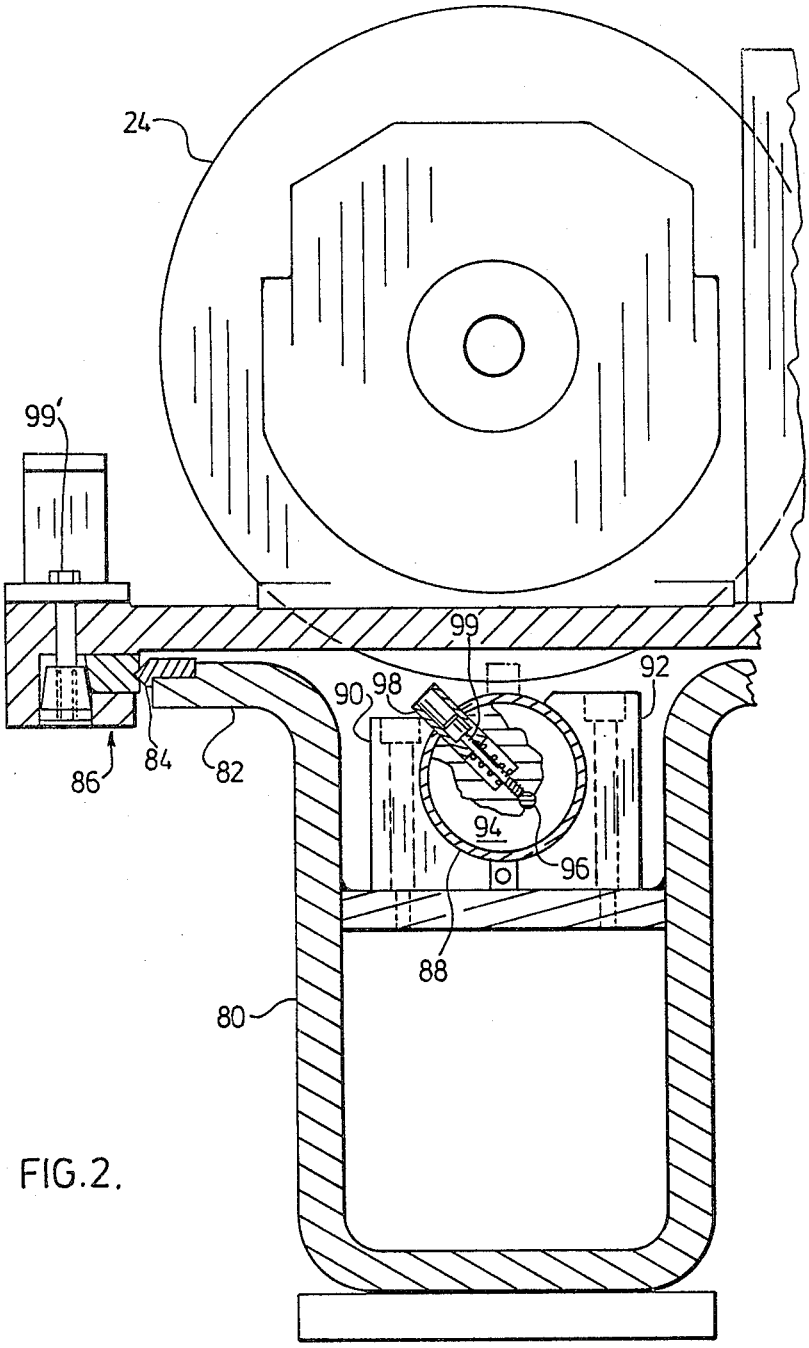
FIG. 2 is a similar view of a second embodiment wherein the traverse means comprises an elongated bar mounted in a slideway.

Turning to the FIG. 2 embodiment, a structural channel 80 extending across the width of the slitter 10 is provided with upper lip portions 82 having slide guides 84 on which are located the mounting slides 86 for each of the slitter head lower portions. The slitter band annular disc 24 of each head occupies the position shown.

An elongated traverse bar 88 is rotatably and axially slideably mounted in a plurality of support blocks 90, 92, which, in combination with the channel 80 provide a traverse way by which the traverse bar is withdrawable into the aisle fronting the machine 10. A plurality of spacer blocks 94 are threaded upon a laterally flexible rod 96 mounted within the traverse bar 88. Each spacer block 94 includes a stop member 98 through which extends a locking screw 99 of the Allen (TM) type. The inner end of the screw 99 makes locking engagement with the rod 96, to secure the spacer blocks and the stop members 98 in mutually fixed axial relation upon the rod 96 within the bar 88.

In operation, withdrawal of the traverse bar 88 along its way, from out of the slitter section 10 provides access to each of the stop members 98, permitting them to be selectively individually positioned on the rod 96, along the traverse bar 88.

Upon returning the traverse bar 88 within the slitter 10, the slitter is then ready to be indexed. After withdrawal of the web, and stopping the rotation of the slitter motors (not shown) the slitter discs 24 are released by way of capscrews 99', for repositioning along the channel 80. Positioning all of the discs 24 out of the plane of the respective stop member 98, in its reset position, the traverse bar 88 is then rotated about its polar axis using a toggle bar, manually, or a suitable actuation device, thereby displacing the stop members 98 upwardly through an arc into indexible relation with the discs 24, as shown in phantom in FIG. 2.

The disc 24 of each slitter head lower portion can then be moved into registry with the respective stop member 98. The additional indexing of the top portions of each slitting head can then be completed, as before described.

Downward retraction of the stop members 98 is then effected, by returning the traverse bar 88 to its original, illustrated position. This leaves the machine 10 in condition to recommence slitting operation.

What we claim as new and desire to secure by Letters Patent of the United States of America is:

1. A slitter machine for use in slitting an endless travelling web into a plurality of strips for subsequent winding into individual rolls, the machine having a plurality of sets of slitter disc means in adjustably spaced apart relation in the cross-machine direction, a plurality of slitter indexing means adjustably mounted on and movable with a traverse means extending in the cross-machine direction, said traverse means being movable between a predetermined operative position and a retracted position extending laterally from the machine along a traverse way which receives the traverse means for retraction and return therealong to said predetermined operative position during operation of the machine, and index locking means securing the indexing means in predetermined mutually spaced apart relation along the traverse means.

2. The machine as claimed in claim 1, said slitter indexing means each having a stop portion including a reference surface for contacting a predetermined portion of a said slitter disc means in indexing relation therewith in the cross-machine direction, and stop displacement means for displacing said indexing means from a first retracted position clear of said slitter disc means to a second advanced position in indexible relation with the slitter disc means.

3. The machine as claimed in claim 1, said traverse means comprising a wheeled carriage, and said traverse way including rail means to guide the carriage therealong.

4. The machine as claimed in claim 1, said traverse means comprising elongated bar means, said traverse way being bounded by guide support means to locate the bar means relative to said slitter disc means in spaced relation therefrom.

5. The machine as claimed in claim 3, said slitter indexing means each having a stop portion including a reference surface for contacting a predetermined portion of said slitter disc means in indexing relation therewith in the cross-machine direction, said stop displacement means individually displacing each stop portion from a first retracted position to a second, advanced indexing position in indexible relation with the slitter disc means.

6. The machine as claimed in claim 4, said slitter indexing means each having a stop portion including a reference surface for contacting a predetermined portion of a said slitter disc means in indexing relation therewith in the cross-machine direction, and stop displacement means for pivoting said elongated bar means about a longitudinal axis extending across the machine, to bring the reference surfaces into indexible relation with the slitter disc means.

7. The machine as claimed in claim 1, each said set of slitter disc means including a slitter band ring and a slitter head having a rotatable annular blade axially positionable in web slitting relation with the respective band ring.

8. The machine as claimed in claim 7, each said slitter indexing means having a reference surface for making contact with a cutter edge of said slitter ring portion.

9. The machine as claimed in claim 8, said slitter ring cutter edge making contact with said rotatable blade portion of said slitter set when set in an operative condition.

10. The machine as claimed in claim 5, said stop displacement means each including a fluid cylinder to raise a respective said index stop portion upwardly to said indexing position.

11. The machine as claimed in claim 10, said fluid cylinder comprising an air cylinder operable to raise said index stop portion on the admission of air thereto.

12. The method of operating a slitting machine for slitting an endless wide web, said machine having a plurality of mutually spaced apart slitting means normally inaccessible during operation of the machine when slitting a web, comprising the steps of;

providing a plurality of individually adjustable slitter indexing means, one for each said slitting means, mounted on traverse means storable within the slitting machine and withdrawable therefrom during continuing operation of the machine;

withdrawing the traverse means to a position providing access to the indexing means;

adjusting the respective positions of at least selected ones of the indexing means along the length of the traverse means relative to a predetermined datum;

re-inserting the traverse means within the machine in predetermined spaced related therewith, and resetting the slitting means to the indexing means when the machine in inoperative.

* * * * *